United States Patent [19]

Wyler

[11] 4,025,137

[45] May 24, 1977

[54] TERRACED TELESCOPIC STORAGE SHELVES

[76] Inventor: Margaret C. Wyler, 146 E. 100 North, St. George, Utah 84770

[22] Filed: July 25, 1975

[21] Appl. No.: 599,320

[52] U.S. Cl. ..... 312/114; 312/205; 108/93; 248/172; 220/8

[51] Int. Cl.[2] ..... A47B 45/00; A47B 57/00

[58] Field of Search ..... 312/114, 205, 278; 211/50, 52, 135, 153; 220/8; 108/92, 93, 99; 248/172, 174; D6/186

[56] References Cited

UNITED STATES PATENTS

| | | | |
|---|---|---|---|
| 974,852 | 11/1910 | Bishop | 211/135 |
| 1,120,955 | 12/1914 | Martin | 312/205 |
| 1,706,240 | 3/1929 | Liley | 312/278 |
| 2,471,581 | 5/1949 | Poissant | 312/278 |
| 2,664,258 | 12/1953 | Lanier | 312/205 |
| 2,758,000 | 8/1956 | Berry et al. | 312/278 |
| 2,789,700 | 4/1957 | King et al. | 211/50 |
| 2,798,617 | 7/1957 | Schreiber | 108/42 |
| 3,032,905 | 5/1962 | Schultz | 312/114 |
| 3,138,403 | 6/1964 | Danielson | 108/93 |
| 3,215,382 | 11/1965 | Stein | 248/172 |
| 3,564,790 | 2/1971 | Rehfeld | 108/92 |
| 3,648,626 | 3/1972 | Schuster | 211/135 |
| 3,691,671 | 9/1972 | Kroll | 220/8 |
| 3,777,673 | 12/1973 | Blazey et al. | 108/27 |
| 3,908,830 | 9/1975 | Skrzelowski | 312/278 |
| D115,104 | 6/1939 | Erickson | D6/186 |

*Primary Examiner*—Paul R. Gilliam
*Assistant Examiner*—Victor N. Sakran
*Attorney, Agent, or Firm*—Criddle, Thorpe & Western

[57] ABSTRACT

A terraced expandable storage shelf consisting of two telescoping sidepieces each having a back, an outside end, and a terraced front or top consisting of alternating vertical risers and horizontal shelves forming a terraced surface beginning at the front end with a vertical riser and terminating at the upper portion of the backside with a horizontal shelf. One of said sidepieces is just slightly smaller than the other sidepiece so as to telescope therein, allowing for adjustment of the width of the storage shelf, depending upon the degree of telescoping of one side into the other.

2 Claims, 5 Drawing Figures

TERRACED TELESCOPIC STORAGE SHELVES

BACKGROUND OF THE INVENTION

This invention relates to terraced telescoping storage shelves. More specifically, this invention relates to terraced telescoping storage shelves for use in cabinets, kitchen cupboards, tool shelves and the like.

It is often difficult and, in many events, frustrating for the housewife to find a desired spice, or seasoning container, or for the "do-it-yourselfer" in the workshop to locate the desired size of nail, screw, bolt, etc. because all are stored or contained in similar sizes or types of containers, and are all usually on the same horizontal level.

Various means have been developed to alleviate or overcome such problems such as rotating trays, elongated spice shelves or racks, which are enclosed. An obvious disadvantage of such units is that they do not fully utilize all available space or are exposed and are often unsightly in appearance.

It is known in the display art to use cases of limited adjustment in the width of such displays. Such a case is shown in U.S. Pat. No. 2,789,700; which discloses a display case for carton confections such as chewing gum. This case is somewhat adjustable in width but requires separate sidepieces, struts, snap connectors, shelf members, cuts, slots, etc. and, as such, is relatively complicated for the use of which it was designed.

BRIEF SUMMARY OF THE INVENTION

It is an object of the present invention to provide an expandable, telescoping, terraced storage shelf for use in the kitchen, workshop and the like.

It is also an object of this invention to provide a terraced telescoping shelf which can be adjusted to the width of the cupboard or shelf on which it is placed or, in the alternative, adjusted to any other desired position.

It is an additional object of this invention to provide a lightweight and durable telescoping terraced adjustable shelf which can easily be constructed in a variety of materials and colors.

It is a further object of this invention to provide a telescoping adjustable terraced storage shelf which is simple to assemble and adjust and which, if desired, may be locked in a fixed position.

These and other objects may be accomplished by means of an adjustable terraced storage shelf consisting of two sidepieces, one of which is sufficiently smaller than the other so as to be telescoped therein. Each sidepiece consists of a backwall and an endwall, the endwall assuming the configuration of the terraced steps. The terracing begins with a vertical riser at the front portion of the endwall and then alternates in vertical risers and horizontal shelves terminating with a horizontal shelf which is contiguous with the top portion of the backwall. The height and depth of each terrace can be predetermined according to the desired end use to be made of the storage shelf. Ideally, each sidepiece will be of similar width so that when fully telescoped the shelf will be of approximately the same width as one sidepiece but can be expanded to approximately the full length of both sidepieces.

Obviously, the size of each unit will be dictated by the use to which it is to be put. Units designed to fit in kitchen cupboards, for example, could be 12 inches long for each sidepiece and expand to 23 inches, or they could be 16 inches long and expand to 30 inches or whatever length is desired. It will be obvious that each set of shelves provides one more usable shelf level than the number of shelves contained on the terraced shelf unit since the cupboard shelf, or whatever it is placed upon, will provide the lowest level. For kitchen use, for example, the vertical risers could be 1½ to 2 inches high and the shelves could be of similar width, or deeper if desired. For workshop use, i.e., for holding small tools, paint cans, nuts, bolts, etc. the shelves would be made of a heavier, thicker material and the terraces would be higher and wider than those provided for kitchen use.

Suitably, each unit is constructed of a molded piece of impact resistant plastic which may vary from one-eighth to five thirty-seconds of an inch in thickness or thicker if desired. It is also obvious that other materials of construction such as aluminum, steel, etc. may likewise be used.

The novel features of this invention both as to the manner of construction and organization, as well as operation, will be better understood with reference to the following description and drawings. It is to be understood, however, that the description and drawings are for the purpose of illustration only and are not intended to be a definition as to the scope of this invention.

DRAWINGS OF THE INVENTION

DETAILED DESCRIPTION

Referring now to the drawings

Figure 1:
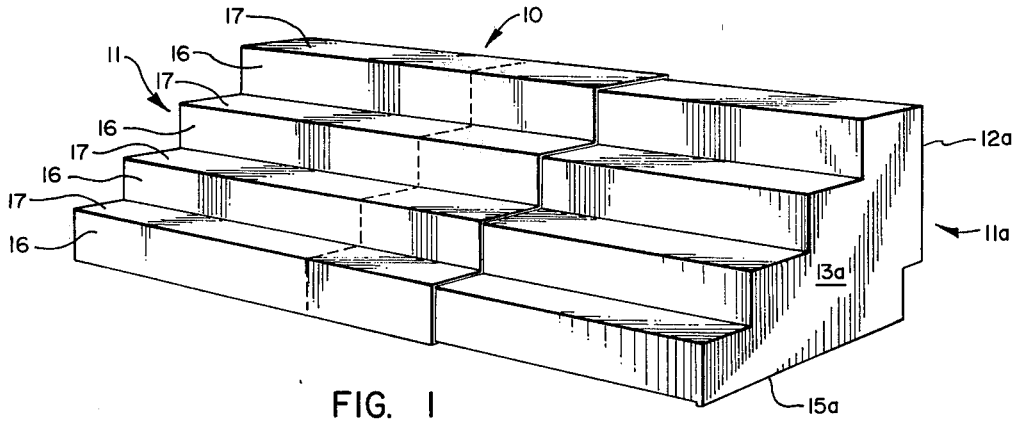
FIG. 1 is a perspective view of the telescopic terraced storage shelves in assembled position, the end of the inner sidepiece being shown by dotted lines.
Figure 2:
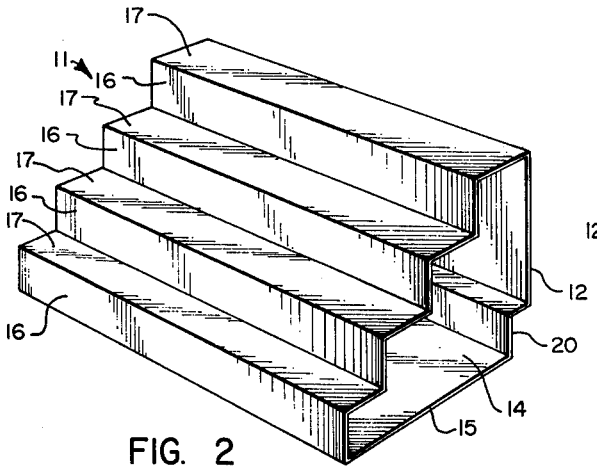
FIGS. 2 and 3 are perspective views showing the inside ends of each unassembled sidepiece.
Figure 3:
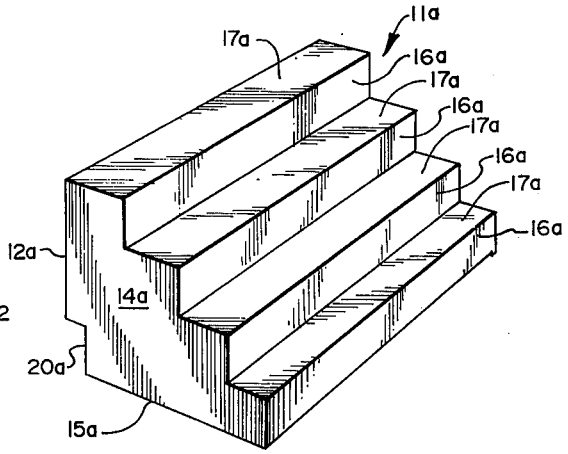
Figure 4:
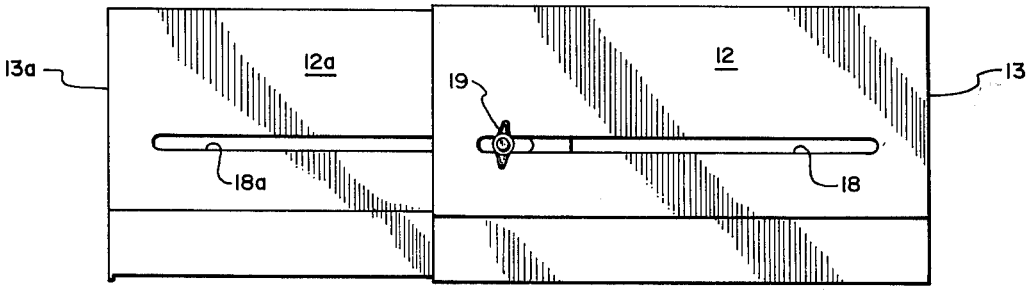
FIG. 4 is a back elevational view of the terraced shelf showing the elongated slots and a means for locking the slots in a fixed position.

As shown by the drawings the expandable terraced storage shelf 10 consists of two sidepieces 11 and **11*a* with sidepiece 11 being slightly larger than 11*a* thereby allowing sidepiece 11*a* to be slidably engaged into sidepiece 11 in the manner hereinafter described. Each sidepiece contains a back designated as 12 and 12*a* and an outside end designated as 13 and 13*a*. The outside end 13 and 13*a* corresponds to the shape of the terraced steps as will be defined. The inside end of the larger sidepiece 11 consists of an opening 14 into which sidepiece 11*a* may be slidably engaged. Preferably sidepiece 11*a* is smaller than sidepiece 11 only by the thickness of the material used to make sidepiece 11. In this manner a snug fit is obtained when the two sidepieces are telescoped together. The end 14*a* of sidepiece 11*a* which telescopes into sidepiece 11 may be closed by a wall or may be open as in sidepiece 11**.

Sidepieces 11 and **11*a* may contain floors 15 and 15*a* as illustrated in the drawings, or in the alternative, may be open. Additionally, only section 11 may have a floor 15 and section 11*a* may be open. Preferably at least section 11 will contain a floor so that when the sections 11 and 11*a* are telescoped together they can be moved as one piece. Moreover, the presence of a floor will provide additional stability and strength to each unit. If section 11 contains a floor 15 then end 13***a* will preferably extend downwardly past the first vertical riser and the backwall to provide a leg upon which section 11*a* may rest when expanded or telescoped outwardly from section 11. If such an extension is not provided the sidepiece 11*a* would not be balanced and would have a tendency to tip downwardly when the load on such section exceeded the load placed on section 11. In a preferred embodiment of this invention both sections 11 and 11*a* will contain floors 15 and 15*a*.

The terraced steps consist of alternating vertical risers 16 and 16*a* and horizontal shelves beginning 17 and 17*a* with a riser 17 at front end of the end portion 13 and 13*a* and ending in a horizontal shelf which is contiguous with the top of back 12 and 12*a*. As previously stated the spacing of the vertical risers and horizontal steps is entirely dependent upon the use to which they are to be put and any enumeration of dimensions would be illustrative only.

In some instances it may be desirable to lock or secure the telescoping sections 11 and 11*a* in a fixed position. For this purpose an elongated slot 18 and 18*a* may be provided in the back of each section 12 and 12*a*, and securing means 19 may be inserted therein which will lock the two sections 11 and 11*a* in any given position. If section 11*a* has no floor the insertion of fastening means 19 into the elongated slots 18 and 18*a* will pose no problem. However, should both sections 11 and 11*a* contain floors 15 and 15*a* various anchoring means such as winged bolts may still be used. Obviously, other equivalent fastening means may be invisioned without departing from the scope of this invention.

Figure 5:
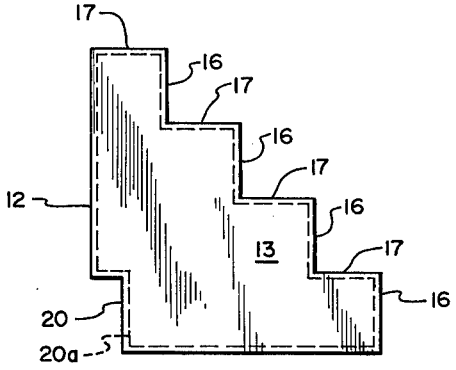
FIG. 5 is an end elevational view of one embodiment of the invention containing a notched portion at the bottom of the backend thereof.

In some instances there may be a brace across the back of a shelf in a cabinet or cupboard which would prevent the terraced storage unit 10 from fitting snugly against the back of said shelf. In such case the storage unit 10 may be made with a notch 20 and 20*a* as illustrated in FIG. 5 which will fit around said brace and still allow positioning of the terraced storage unit flush against the wall.

From the above disclosure it is obvious that the telescoping shelves of this invention may be placed through openings too small to accommodate the expanded shelves and the shelves may then be telescoped outwardly to the desired position and, if necessary, fixedly locked in place. While each section as described herein may be formed separately and then bonded together by gluing, ultrasonics or other means, it is preferred that each section 11 and 11*a* be injection molded and each part thereof be integral with the others.

While the above invention has been described in what is deemed to be the preferred embodiment, it is recognized that departures may be made therefrom without departing from the scope of the invention which is not to be limited to the details disclosed, but is to be accorded the full scope of the claims so as to include any and all equivalent devices and units.

What is claimed is:

1. A horizontally adjustable terraced storage shelf consisting of two sidepieces of about the same width one of which is slightly smaller and will substantially completely telescope into the other, each sidepiece containing a backwall, an outside endwall and a terraced front consisting of alternating vertical risers and horizontal shelves beginning with a vertical riser at the front lower edge of the outside endwall and terminating with a horizontal shelf which is contiguous with the back top portion of said outside endwall and the top of said back wall, wherein the lower portion of each endwall and corresponding sidewall portion extends inwardly at right angles and then downwardly to define a notch in the bottom portion thereof.

2. A horizontally adjustable storage shelf according to claim 1 wherein the smaller sidepiece is of substantially the same length as the larger sidepiece.

* * * * *